US005462576A

United States Patent [19]

Stuitje et al.

[11] Patent Number: 5,462,576

[45] Date of Patent: Oct. 31, 1995

[54] HEAVY METAL ALLOY AND METHOD FOR ITS PRODUCTION

[75] Inventors: Peter Stuitje, Vught/NL; Ronald Harkema, Eindhoven/NL; Cornelie Taal, Krp/NL, all of Netherlands

[73] Assignee: NWM de Kruithoorn B.V., JX 's-Hertogenboch, Netherlands

[21] Appl. No.: 254,876

[22] Filed: Jun. 6, 1994

[30] Foreign Application Priority Data

Jun. 7, 1993 [DE] Germany ..... 43 18 827.3

[51] Int. Cl.[6] ..... C22C 27/04; B22F 3/00

[52] U.S. Cl. ..... 75/248; 148/668; 419/29; 419/54

[58] Field of Search ..... 75/248; 419/29, 419/54; 148/514, 668

[56] References Cited

U.S. PATENT DOCUMENTS

| | | | |
|---|---|---|---|
| 3,979,234 | 9/1976 | Northcutt, Jr. et al. | 148/126 |
| 4,012,230 | 3/1977 | Dickinson et al. | 75/212 |
| 4,762,559 | 8/1988 | Penrice et al. | 75/248 |
| 4,918,140 | 4/1990 | Peccoux et al. | 524/860 |
| 5,064,462 | 11/1991 | Mullendore et al. | 75/248 |

FOREIGN PATENT DOCUMENTS

| | | |
|---|---|---|
| 204909 | 12/1986 | European Pat. Off. . |
| 0304181 | 2/1989 | European Pat. Off. . |
| 0313484 | 4/1989 | European Pat. Off. . |
| 1139051 | 1/1969 | United Kingdom . |

OTHER PUBLICATIONS

Kang et al., "Einflub der Wärmebehandlung auf die mechanischen Eigenschaften der 90W–7Ni–3Fe–Schwermetallegierung[1]", Z. Metallkunde, vol. 78, pp. 250–258 (1987).

*Primary Examiner*—Ngoclan Mai
*Attorney, Agent, or Firm*—Spencer, Frank & Schneider

[57] ABSTRACT

The invention relates to a heavy metal alloy comprising from about 85 to 98 weight-% tungsten that is essentially present in the form of globular tungsten grains, and nickel and cobalt in a Ni/Co weight ratio approximately between 1.6 and 3.5 as binder elements in an austenitic binder phase which also contains tungsten in solid solution, wherein the alloy sintered from the appropriate powders is subjected to a heat treatment, and a method for its production. The alloy permits the attainment of very high strength values with the retention of high ductility.

15 Claims, 3 Drawing Sheets

FIG.5
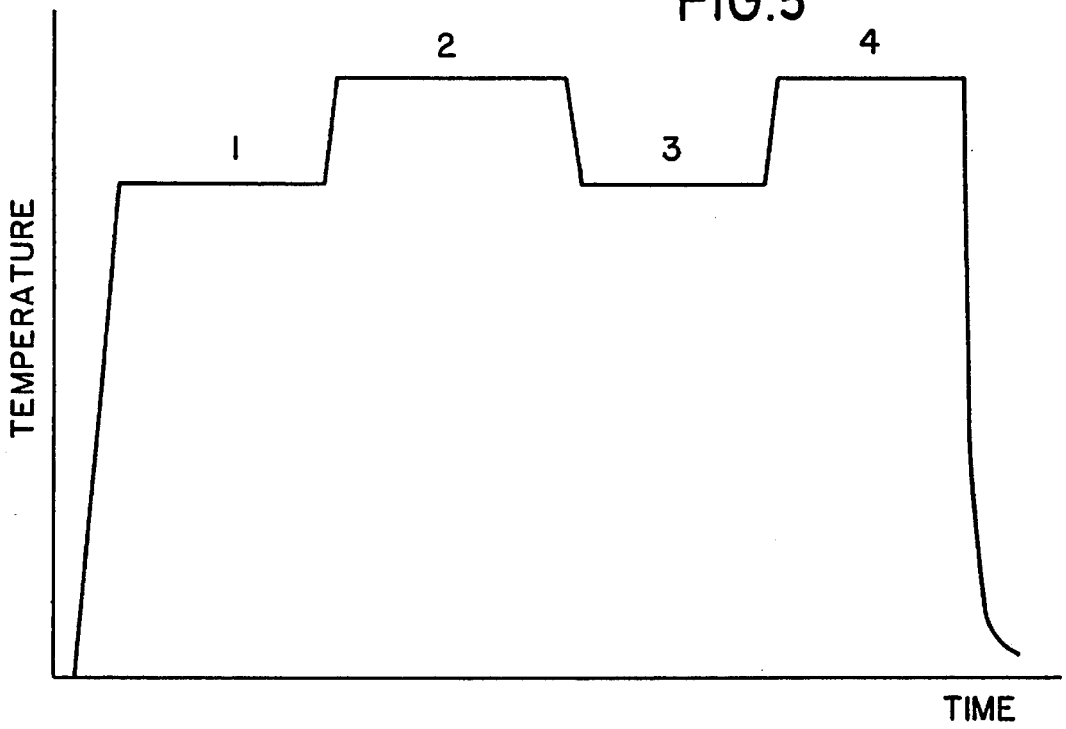
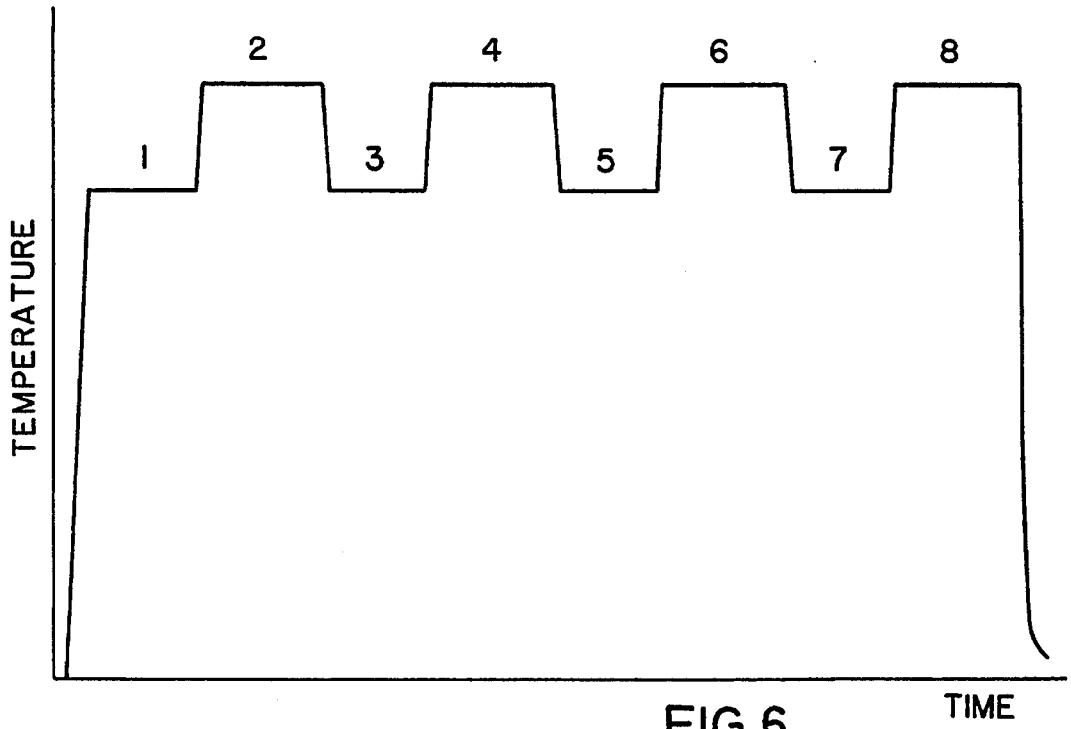
FIG.6

HEAVY METAL ALLOY AND METHOD FOR ITS PRODUCTION

CROSS-REFERENCE TO RELATED APPLICATION

This application is related to German application No. P 43 18 827.3 filed Jun. 7, 1993, the entire disclosure of which is incorporated herein by reference.

FIELD OF THE INVENTION

The invention relates to a heavy metal alloy comprising about 85 to 98 weight-% tungsten, which is essentially present in the form of globular tungsten grains, as well as nickel and cobalt in a Ni/Co weight ratio approximately between 1.6 and 3.5 as binder elements; the austenitic binder phase further contains tungsten in solid solution. The invention further relates to a method for producing the alloy.

TECHNOLOGY REVIEW

Heavy metal alloys comprising W, Ni and Fe are known from U.S. Pat. No. 3,979,234, in which, after mixing, the appropriate powders are pressed, sintered, heat-treated and worked. An alloy that has a high density and a structure of globular tungsten particles embedded in an austenitic binder phase results from sintering binder elements Ni and Fe in the liquid state. During liquid phase length to diameter, the penetrator material must meet high bending and transverse load capability requirements in sintering, a rapid growth of the tungsten particles into relatively coarse grains within a range of 20 to 60 μm generally occurs, a phenomenon known as Ostwald's ripening. A consequence of this is that strength and ductility are limited by the tungsten sintering grain size, particularly with tungsten amounts of 90 to 97 weight-%.

Tank warfare requires penetrators of tungsten heavy metal that have high strength and ductility. Particularly with angled targets and penetrators having larger ratios of length to diameter, the penetrator material must meet high bending and transverse load capability requirements in order to assure a successful launch and realize high penetration capability.

To accomplish this, it is known from U.S. Pat. No. 4,012,230 to produce W-Ni-Co heavy metal alloys with the use of tungsten powder particles coated with binder elements Ni and Co, by means of which a fine-grain structure that has a tungsten grain size of approximately 8 μm is obtained because of the relatively low sintering temperature. This results in a marked increase in hardness. However, this method is very costly because of the use of coated tungsten powder particles.

A 93 W, 5.6 Ni, 1.4 Co heavy metal alloy known from U.S. Pat. No. 5,064,462 is assumed to be able to withstand higher bending moments because cobalt reduces the interfacial energy between the solid and liquid phase, which is intended to suppress "Ostwald's ripening."

Experiments involving the influence of heat treatments in $H_2$ and Ar atmospheres with regard to ultimate tensile strength and elongation after fracture of heavy metal alloys are known from Thae-Khapp Kang, Ernst-Theo Henig and Günter Petzow, "EinfluB der Wärmebehandlung auf die mechanischen Eigenschaften der 90W-7Ni-3Fe Schwermetallegierung" [The Influence of Heat Treatment on the Mechanical Properties of the 90W-7Ni-3Fe Heavy Metal Alloy], Z. Metallkunde [Journal of Metallography], vol. 78 (1987), pp. 250–258. In isothermal heat treatment at 900° C. in the above-named atmospheres, discontinuous tungsten precipitates are seen in the binder matrix phase of the investigated alloy; these have no significant influence on ultimate tensile strength and elongation after fracture.

It is known from EP 0,313,484 to subject a W-Ni-Fe heavy metal alloy that may also contain Co to a cycle comprising a heat treatment between 1000° and 1300° C. and a working pass multiple times in order to increase the breaking strength values by way of deforming and aligning the globular tungsten particles.

SUMMARY OF THE INVENTION

It is an object of the invention to create a heavy metal alloy comprising about 85 to 98 weight-% tungsten, which is essentially present in the form of globular tungsten grains, as well as nickel and cobalt in a Ni/Co weight ratio approximately between 1.6 and 3.5 as binder elements; the austenitic binder phase containing tungsten in solid solution, with which very high strength can be set.

This is accomplished in that, in comparison to the globular tungsten grains, the binder phase contains very small tungsten precipitates that are extensively uniformly distributed.

The fine tungsten precipitates which are distributed uniformly throughout the binder phase can advisably constitute a volume percent greater than 1%, preferably between about 10 and 20%, particularly about 15%, of the binder phase. The tungsten precipitates can have an average particle size within a range of approximately 10 to 1000 nm, preferably less than 500 nm.

BRIEF DESCRIPTION OF THE DRAWINGS

FIG. 5 is a schematic illustration of a time-temperature curve to obtain fine grain tungsten precipitates in the binder phase of a W-Ni-Co heavy metal alloy.

FIG. 6 is another schematic illustration showing an increased number of transformation and solution cycles to increase the quantity of tungsten precipitate in the binder phase.

DETAILED DESCRIPTION OF THE INVENTION

Tensile strengths of 950 to 1000 MPa are associated with known tungsten heavy metal alloys in the non-worked state, with elongations after fracture of 20 to 40% and impact energy being within a range of 100 to 300 Joules. In tungsten heavy metal alloys according to the invention, having fine tungsten precipitates in the binder phase-likewise in the non-worked state-tensile strengths of approximately 1100 MPa are achieved with a simultaneous elongations after fracture of approximately 40% and an impact energy of approximately 400 Joules. After additional thermomechanical treatment, a strength level of, for example, 1700 MPa can be achieved with 10% elongation after fracture and an impact energy of approximately 100 Joules.

To obtain the fine tungsten precipitates according to the invention in extensively uniform distribution in the binder phase, the alloy sintered from the appropriate powders (which can comprise particles having a Fisher diameter of approximately 1 to 15 μm) is subjected to a heat treatment. This heat treatment includes at least one cycle comprising an isothermic annealing within a range of approximately 800° to 1050° C., particularly about 950° C., causing at least partial transformation of the binder alloy into an intermetallic β' phase. The heat treatment further includes subsequent annealing within a range of 1100° to 1200° C., particularly about 1150° C., to achieve at least partial redissolution of the intermetallic β' phase, after which rapid cooling to about ambient temperature (20° C.) is executed, which suppresses the reformation and growth of the β' phase.

The precipitate hardening of the binder alloy proceeds from a phase transformation of the binder into an intermetallic β' phase that contains more tungsten than the austenitic binder phase. As a result, greater differences in tungsten concentrations in the binders are created.

The β' is a brittle, ternary, intermetallic phase having the stoichiometric composition $(Ni, Co)_3W$. The crystal structure of the β' phase is orthorhombic in nature and has lattice dimensions a=5,0924 Angström units, b=4.1753 Angström units and c=4.4472 Angström units. Moreover, the β' phase is an ordered structure possessing no metastable properties.

The transformation of the binder alloy (gamma phase) into the intermetallic β' phase starts with the W/gamma/boundaries in the initial phase of the transformation. Increasing annealing times result in greater ranges with β' phase components. After the first isothermic transformation, a binder structure results that has been converted to approximately 50 to 100%, preferably to approximately 80%, into the β' phase; no tungsten precipitates have occurred yet in the binder phase. These do not come about until the β' phase is re-dissolved at higher temperatures during subsequent solution annealing.

Figure 1:
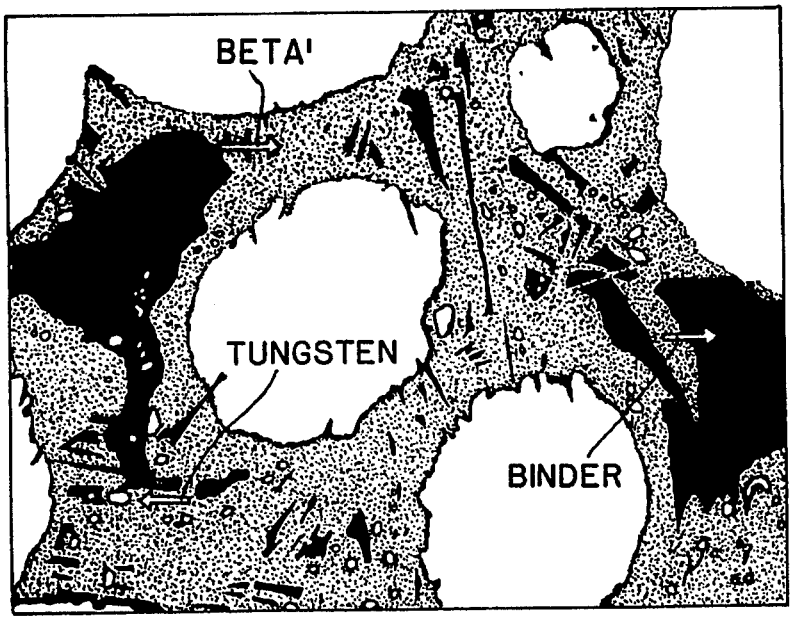
FIG. 1 shows tungsten precipitation in the transformed binder phase.

After one-time transformation and solution annealing, the degree of tungsten precipitation is still relatively small. To increase it, the transformation of the gamma phase into the β' phase is repeated (a corresponding example for a structure is shown in FIG. 1), after which solution annealing is repeated.

Further embodiments of the invention are to be taken from the following description and dependent claims.

The invention is described in detail below by way of the attached drawing figures.

Figure 2:
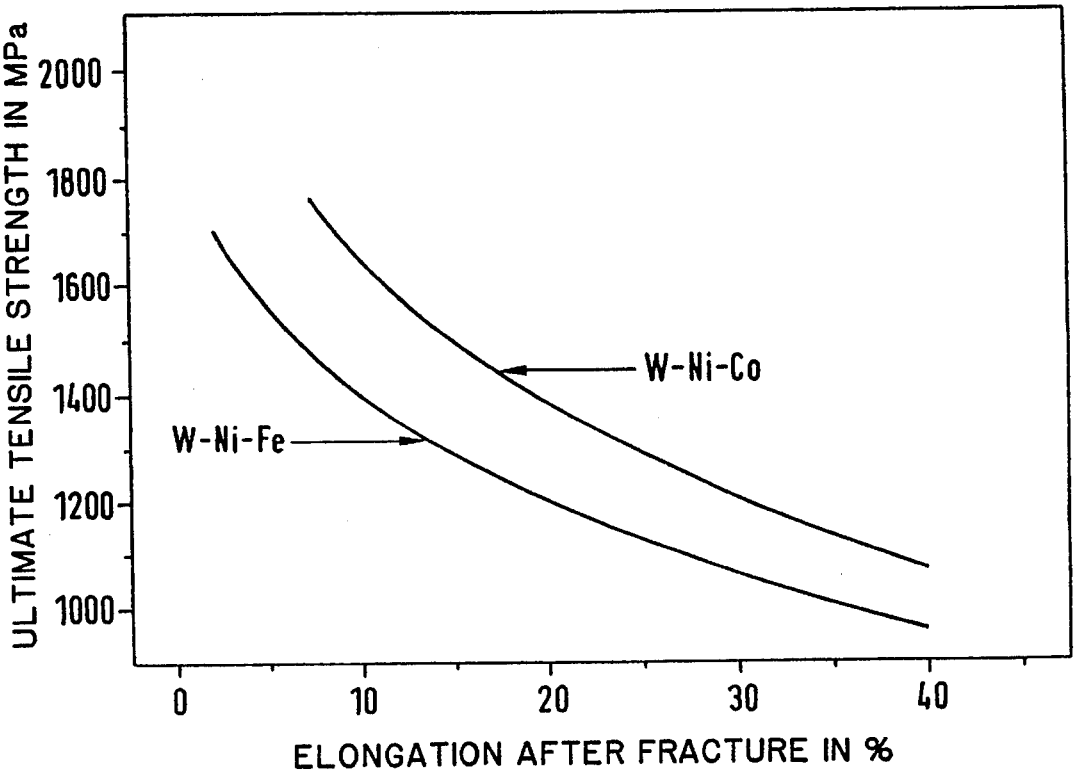
FIG. 2 illustrates ultimate tensile strength (in MPa) with respect to elongation after fracture (in %) for a sintered 93W-6Ni-1Fe heavy metal alloy, and for a sintered 91W-6Ni-3Co heavy metal alloy.
Figure 3:
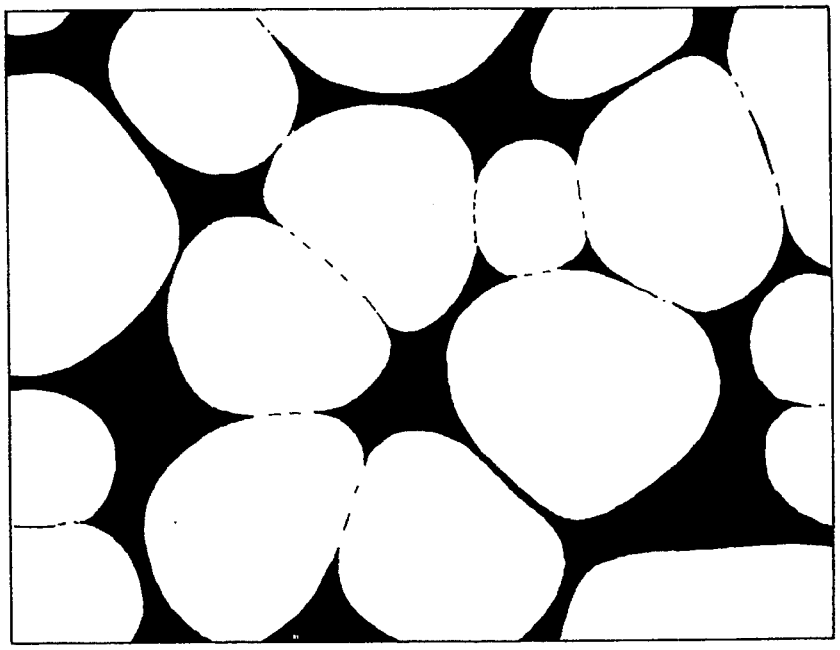
FIG. 3 shows the structure of a 93W-6Ni-1Fe heavy metal alloy.

FIG. 2 shows a diagram in which ultimate tensile strength (in MPa) is represented with respect to elongation after fracture (in %) for a sintered 93W-6Ni-1Fe heavy metal alloy (whose structure is illustrated in FIG. 3) and a sintered 91W-6Ni-3Co heavy metal alloy (alloy compositions in weight-%) that is subjected to a subsequent, at least one-time heat treatment with transformation annealing at 950° C. for 4.5 hours, and solution annealing at 1150° C. for 5 hours, followed by a rapid quenching of the solution temperature to ambient temperature. Moreover, the diagram shows the curves over the development of the two values by means of additional thermomechanical treatment (about one or more cycles comprising working and annealing). The W-Ni-Co heavy metal alloy having fine tungsten precipitates in the binder phase exhibits clearly improved strength and ductility properties.

Figure 4:
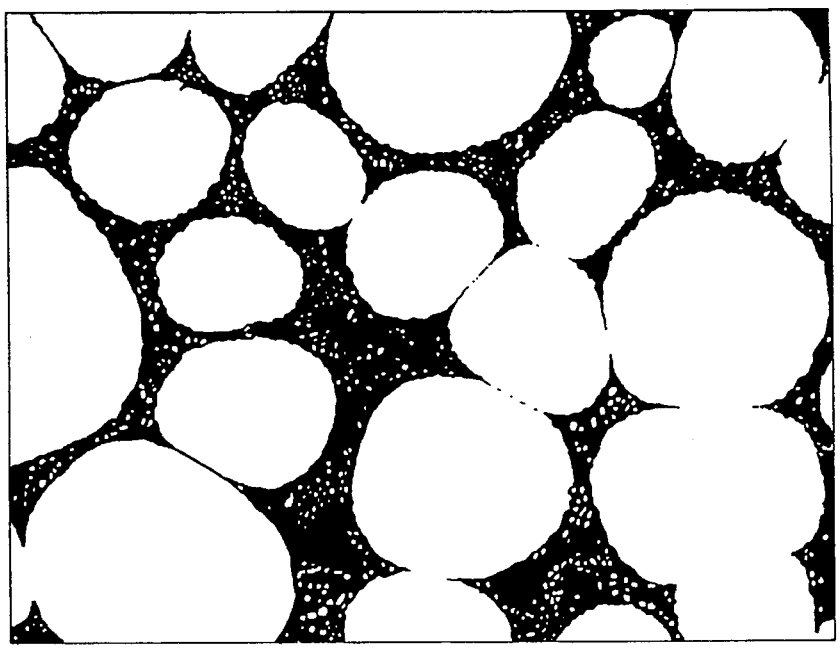
FIG. 4 shows the structure of a W-Ni-Co heavy metal alloy which has been subjected to a heat treatment, without a thermomechanical treatment.

FIG. 4 shows the structure of a W-Ni-Co alloy that has been subjected to a heat treatment comprising at least one cycle of transformation annealing and solution annealing (without thermomechanical treatment). Along with the tungsten grains, which appear white, large and globular (alpha phase), tungsten precipitates that are extensively uniformly distributed over the binder matrix, are very small compared to the globular tungsten grains and are not lamellar appear in the binder matrix, which appears black.

The binder alloy is not depleted of tungsten in this state; rather, it contains approximately 42 weight-% tungsten in solid solution, which is a relatively large quantity of tungsten by order of magnitude.

Because both cobalt and tungsten reduce the stacking fault energy, the binder phase produces significant increases in hardening, after deformation; mechanisms that further increase hardness, as are generally known for particle hardening in relation to dislocations, can be used in the binder alloy, so that the strength can be significantly increased with the retention of correspondingly higher ductility.

FIG. 5 is a schematic representation of an example of a temperature-time curve for a heat treatment for achieving the finest-grain tungsten precipitates in the binder phase of W-Ni-Co heavy metal alloys. If the number of transformation and solution cycles is increased, as shown in FIG. 6, a maximum desired quantity of tungsten precipitates can be set in the binder phase.

The isothermic transformation to be executed particularly with a vacuum is advisably executed for a duration of approximately 0.5 to 20 hours, for example 4.5 hours, while solution annealing can be executed for approximately 0.2 to 10 hours, for example 5 hours.

It is understood that various other modifications will be apparent to and can readily be made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A heavy metal alloy comprising from about 85 to 98 weight-% tungsten present in the form of a globular tungsten grains, and nickel and cobalt in a Ni/Co weight ratio approximately between 1.6 and 3.5 as binder elements in an austenitic binder phase which also contains tungsten in solid solution, said binder phase also containing tungsten precipitates which are finer-grained than the globular tungsten grains and which are uniformly distributed.

2. The heavy metal alloy as defined in claim 1, wherein the tungsten precipitates are present in a volume percentage greater than 1%.

3. The heavy metal alloy as defined in claim 1, wherein the tungsten precipitates have an average particle size within a range of approximately 10 to 1000 nm.

4. The heavy metal alloy as defined in claim 1, wherein the tungsten precipitates have an average particle size within a range of approximately 10 to 500 nm.

5. The heavy metal alloy as defined in claim 2, wherein the tungsten precipitates are present in a volume percentage between about 10 and 20 percent.

6. The heavy metal alloy as defined in claim 2, wherein the tungsten precipitates are present in a volume percentage of about 15 percent.

7. A method for producing a heavy metal alloy, comprising:

preparing an alloy comprising from about 85 to 98 weight percent tungsten, and nickel and cobalt in a Ni/Co weight ratio approximately between 1.6 and 3.5;

isothermally annealing said alloy at a temperature within a range of approximately 800° C. to 1,050° C. to form an intermetallic β' phase;

further annealing said alloy containing an intermetallic β' phase at a temperature within a range of approximately 1,100° to 1,200° C. to at least partially re-dissolve said intermetallic β' phase; and rapidly cooling said alloy to about 20° C.

8. The method as defined in claim 7, wherein said intermetallic β' phase has a stoichiometric composition: $(Ni, CO)_3W$.

9. The method as defined in claim 7, including repeating said isothermal annealing, said further annealing, and said rapid cooling steps.

10. The method as defined in claim 7, wherein the isothermal annealing is at approximately 950° C.

11. The method as defined in claim 7, wherein the further annealing is at approximately 1,150° C.

12. The method as defined in claim 7, wherein the isothermal annealing is for a period of about 1.5 to 20 hours.

13. The method as defined in claim 7, wherein the further annealing is for a period of about 0.2 to 10 hours.

14. A method as defined in claim 7, wherein the isothermal annealing takes place in a vacuum.

15. A heavy metal alloy produced by the method as defined in claim 7.

* * * * *

UNITED STATES PATENT AND TRADEMARK OFFICE

CERTIFICATE OF CORRECTION

PATENT NO. : 5,462,576

DATED : October 31, 1995

INVENTOR(S) : Peter STUITJE; Ronald HARKEMA; and Cornelis TAAL

It is certified that error appears in the above-indentified patent and that said Letters Patent is hereby corrected as shown below:

On the title page, please correct the following items:

Item [75] Inventors: Peter Stuitje, Vught/NL;
Ronald Harkema, Eindhoven/NL;
Cornelis Taal, Erp/NL, all of
Netherlands.

UNITED STATES PATENT AND TRADEMARK OFFICE

CERTIFICATE OF CORRECTION

PATENT NO. : 5,462,576

DATED : October 31, 1995

INVENTOR(S) : Peter STUITJE; Ronald HARKEMA; and Cornelis TAAL

It is certified that error appears in the above-indentified patent and that said Letters Patent is hereby corrected as shown below:

On the title page, item:

[56] References Cited

OTHER PUBLICATIONS

Kang et al., "Einfluss der Wärmebehandlung auf die mechanischen Eigenschaften der 90W-7Ni-3Fe-Schwermetallegierung[1]", Z. Metallkunde, Volume 78, pages 250-258 (1987).

At column 1, lines 28 to 30 please delete "length to diameter, the penetrator material must meet high bending and transverse load capability requirements in".

The sentence at column 1, lines 28 to 33 should read as follows:

During liquid phase sintering, a rapid growth of the tungsten particles into relatively coarse grains within a range of 20 to 60 $\mu$m generally occurs, a phenomenon known as Ostwald's ripening.

UNITED STATES PATENT AND TRADEMARK OFFICE

CERTIFICATE OF CORRECTION

PATENT NO. : 5,462,576

DATED : October 31, 1995

INVENTOR(S) : Peter STUITJE; Ronald HARKEMA; and Cornelis TAAL

It is certified that error appears in the above-indentified patent and that said Letters Patent is hereby corrected as shown below:

At column 1, line 63, please correct the line to read

"Günter Petzow, "Einfluss der Wärmebehandlung auf die".

At column 6, lines 9 and 10, please correct Claim 12 to read as follows:

The method as defined in claim 7, wherein the isothermal annealing is for a period of about 0.5 to 20 hours.

Signed and Sealed this

Thirty-first Day of December, 1996

*Attest:*

Bruce Lehman

BRUCE LEHMAN

*Attesting Officer*

*Commissioner of Patents and Trademarks*